US007160197B2

(12) United States Patent
James

(10) Patent No.: US 7,160,197 B2
(45) Date of Patent: Jan. 9, 2007

(54) TARGET IDENTIFIER SPORTS TRAINING AID

(76) Inventor: Randy Lee James, P.O. Box 242720, Little Rock, AR (US) 72223

( * ) Notice: Subject to any disclaimer, the term of this patent is extended or adjusted under 35 U.S.C. 154(b) by 0 days.

(21) Appl. No.: 11/113,473

(22) Filed: Apr. 25, 2005

(65) Prior Publication Data

US 2006/0240901 A1 Oct. 26, 2006

(51) Int. Cl.
*A63B 69/36* (2006.01)

(52) U.S. Cl. ..... 473/174; 473/220; 473/58; 362/259

(58) Field of Classification Search ..... 473/150–197, 473/220, 225, 209; 362/259
See application file for complete search history.

(56) References Cited

U.S. PATENT DOCUMENTS 4,326,718 A * 4/1982 Kiehl ..... 473/209
5,472,204 A * 12/1995 English et al. ..... 473/220
5,527,041 A 6/1996 Terry, III
5,707,296 A * 1/1998 Hodgson et al. ..... 473/220
5,818,036 A 10/1998 Daly
5,964,668 A * 10/1999 Tai et al. ..... 473/220
6,036,608 A 3/2000 Morris
6,071,202 A * 6/2000 Densberger et al. ..... 473/409
6,123,626 A 9/2000 Osborn
6,213,887 B1 4/2001 Carney
6,238,298 B1 5/2001 Chen
6,371,864 B1 4/2002 Norwood
6,701,872 B1 * 3/2004 Allen ..... 119/707
2001/0027136 A1 * 10/2001 Chris ..... 473/220
2002/0123385 A1 * 9/2002 Primiano et al. ..... 473/220
2004/0033842 A1 * 2/2004 Collins et al. ..... 473/220
2004/0062049 A1 * 4/2004 Awa ..... 362/431
2005/0096146 A1 * 5/2005 Burley ..... 473/270
2005/0107180 A1 * 5/2005 Halleck et al. ..... 473/220

* cited by examiner

*Primary Examiner*—Mark S. Graham

(57) ABSTRACT

A sports training aid that displays multiple surface-targets so as to aid the practitioner in acquiring accurate alignment, identifying an intermediate surface-target upon which to focus, and building confidence. The training aid utilizes a beginning point (16*a*), intermediate target (16*b*), and ultimate target (16*c*) sources. The surface-target displayed by the ultimate target source (16*c*) is used to aim at the point where the practitioner ultimately wants his or her ball or object to come to rest. The ball or object is placed upon the surface-target displayed by the beginning point source (16*a*) and is hit so that it passes over the surface-target displayed by the intermediate target source (16*b*), and if hit with the correct amount of force, it will come to rest in or upon the ultimate target. The target sources are housed in or upon the target source containment base (14) and the target source containment base is supported by an angled support shaft (12) which is supported by a weighted base (10).

1 Claim, 6 Drawing Sheets

TARGET IDENTIFIER SPORTS TRAINING AID

CROSS-REFERENCE TO RELATED APPLICATIONS

Not Applicable

FEDERALLY SPONSORED RESEARCH

Not Applicable

SEQUENCE LISTINGS OR PROGRAM

Not Applicable

BACKGROUND OF THE INVENTION

1. Field of Invention

This invention relates to sports training aids, specifically to the sport of golf as it teaches the practitioner to use an "intermediate target" to improve his or her putting, chipping, and long shots.

2. Prior Art

For a practitioner to be successful in golf, he or she must have a functional and repeatable golf swing or stroke, have accurate alignment, and have confidence in his or her swing or stroke and alignment.

To aid the practitioner with the swing or stroke, and alignment, numerous devices have been invented.

One functional type of invention to aid the practitioner with his or her stroke is that where the device attaches directly to the club. U.S. Pat. No. 6,450,893 to Vincent Primiano and Alfred Ganer, U.S. Pat. No. 6,371,864 to John M. Norwood, and U.S. Pat. No. 6,123,626 to Brian S. Osborn are all examples of the functional type of invention that attaches directly to the golf club. Devices in this functional type perform very well in aiding the practitioner to get his or her golf club aligned with the target. But, the problem with this devise is that as the golf club moves, the alignment references move. With any movement, alignment is lost and the swing or stroke becomes improper and inconsistent because the practitioner is left guessing about his or her alignment reference points.

The other functional type of invention to aid the practitioner with his or her stroke is that where the device sits behind the golfer or behind the golf cup. U.S. Pat. No. 6,213,887 to William Carney, U.S. Pat. No. 6,036,608 to John K. Morris, U.S. Pat. No. 5,818,036 to John Daly, and U.S. Pat. No. 6,238,298 to David Chen are all examples of the functional type of invention that displays a line from the golfer to the golf cup. Devices that use this functionality overcome the problem of interrupted alignment for the golf practitioner, but there is a functional problem with the golfer focusing on the continuous line. With a device that constantly shows a straight line from the golf cup to the golf ball, the practitioner's focus is misplaced. His or her focus is concentrated on making the ball roll along the line without the slightest deviation from that line. Once the practitioner has "stuck" the ball with the club, he or she has no more control over whether or not the ball continues perfectly upon the line, thus the practitioner's goal of consistently making the ball roll continually upon the line is both misplaced and unachievable.

In both situations, inconsistent achievement of desired results leads to a failure of confidence and that is an ultimate result of flawed training aids. A training aid that overcomes these two shortcomings is needed to help the golf practitioner become a better golfer.

OBJECTS AND ADVANTAGES

Accordingly, several objects and advantages of my invention are:

(a) to provide the golf practitioner with a stationary alignment reference surface-target on which he or she can focus throughout the golf swing or stroke;

(b) to provide the golf practitioner with an intermediate surface-target upon which he or she can focus his or her concentration;

Other objects and advantages are:

(a) to provide the golf practitioner with an easily achievable goal (the intermediate target) that he or she can achieve on a consistent basis;

(b) to provide the golf practitioner with a simplified method of practice by providing a tool that allows the practitioner to quickly, easily, and visibly establish alignment reference surface-targets from the golf ball (beginning point) to an "intermediate target" and finally to the golf cup (ultimate target);

(c) to provide the golf practitioner with the skills and confidence he or she needs as he or she consistently achieves the goal of causing an object to enter into the "ultimate target;"

Further objects and advantages of my invention will become apparent from a consideration of the drawings and ensuing description.

SUMMARY

In accordance with the present invention, this training aid provides the practitioner with the skills and confidence to successfully achieve his or her goal, at a rate of success that is greater than the practitioner's rate of success prior to using the device, of causing an object to enter into or pass through the "ultimate target." The device sits upon the same surface upon which the golf practitioner stands and displays multiple surface-targets upon the same surface so as to aid the practitioner in acquiring accurate targeting and alignment. The multiple surface-target which are displayed upon the surface of which the practitioner stands are the "beginning point," the "intermediated target," and the "ultimate target."

DRAWINGS—FIGURES

DRAWINGS—REFERENCE NUMERALS

Figures 1, 2:
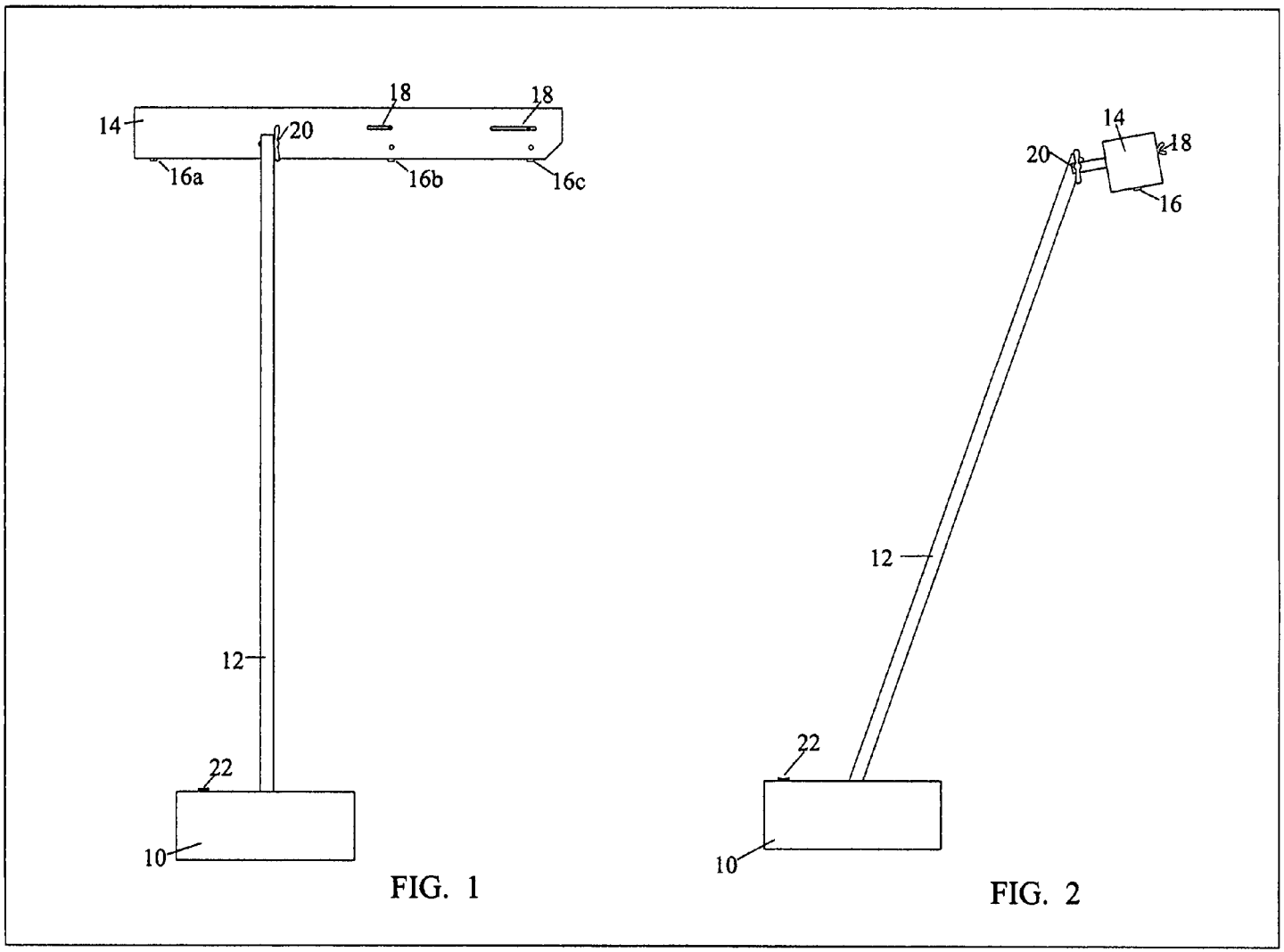
FIG. 1 shows a side view of my invention.
FIG. 2 shows a front or rear view of my invention.
Figure 4:
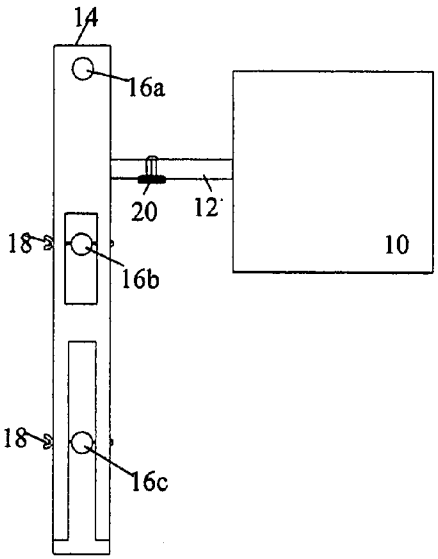
FIG. 4 shows a bottom view of my invention.

10 Weighted Base
12 Angled Support Shaft
14 Target Source Containment Base
16*a* Beginning Point Target Source
16*b* Intermediate Target Source
16*c* Ultimate Target Source
16*d* Additional Intermediate Target Source
18*a* Target Source Adjuster Screw
18*b* Target Source Adjuster Wing Nut
18*c* Target Source Support Pin (Pivotal)
18*d* Target Source Adjuster Connector Rod
18*e* Target Source Support Pin (Fixed)
20 Target Source Containment Base Angle Adjuster
22 Target Source On/Off Switch
24 Battery Compartment with Cover
26 Target Source Wiring
28 Target Source Containment Base Connection Bracket
30 Target Source (Ultimate Target) Yardage Indicator.

DETAILED DESCRIPTION OF PREFERRED EMBODIMENT(S)

The preferred embodiment(s) of my Target Identifier Sports Training Aid is shown in FIGS. 1 through 6. FIGS. 1 through 4 shows side, front and rear, top, and bottom views respectively. The preferred embodiments included in FIGS. 1 through 4 includes a weighted base 10, an angled support shaft 12, a target source containment base 14, target sources 16(*a,b,c*), target source adjusters 18(*a,b,c,d,e*), a target source containment base angle adjuster 20, a target source on and off switch 22, a battery compartment with cover 24, and target source wiring 26.

Figure 5:
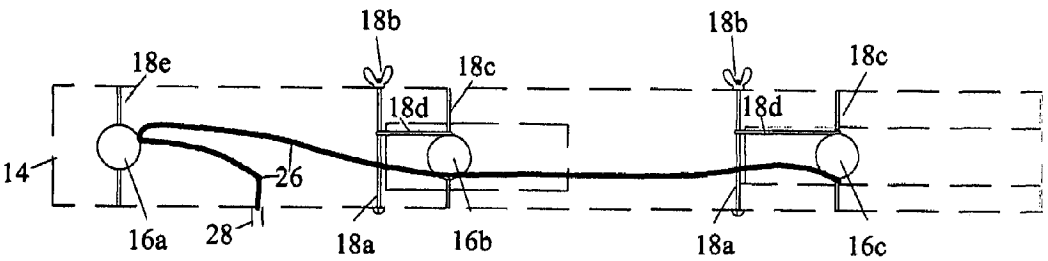
FIG. 5 shows the cut away view of the top of the Target Source Containment Base.
Figure 6:
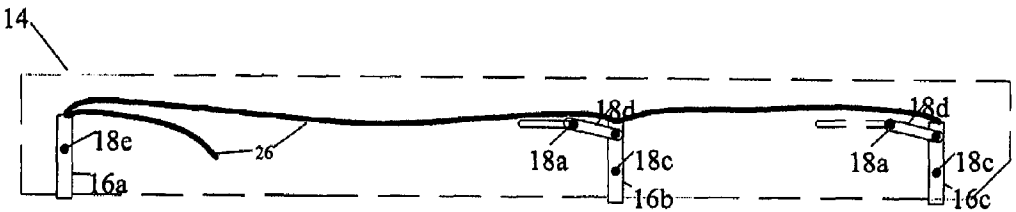
FIG. 6 shows the cut away view of the side of the Target Source Containment Base.

The weighted base 10 is 6" in length and width and 3" in height. It weighs 5 pounds with batteries 24. The weighted base also contains a target source on and off switch 22. Connected to the weighted base 10 is the angled support shaft 12. The angled support shaft 12 is affixed permanently to the weighted base 10 and extends upward at a 70 degree angle, is 2' in length, and ⅜" in diameter. At ¼" from the top of the angled support shaft a ⅛" diameter hole in which the target source containment base connection bracket 28, shown in FIG. 5, is connected by placing a ⅛"×½" bolt through the target source containment base 28 and the angled support shaft 12. The bolt is secured using a wing nut. This connection is labeled as the target source containment base angle adjuster 20. The target source containment base 14 is 12" in length, 2" in height, and 2" in depth. It houses the beginning point target source 16*a*, shown in FIG. 4, that displays the beginning point surface-target, the intermediate target source 16*b* that displays the intermediate surface-target and the ultimate target source 16*c* used to display the ultimate surface-target. The intermediate target source 16*b*, and the ultimate target source 16*c* are connected to target source adjusters 18(*a,b,c,d,e*) which will be discussed more completely as FIGS. 5 through 6 are detailed. The weighted base 10, the angled support shaft 12, and the target source containment base 14 are all made of a rigid plastic.

Figure 3:
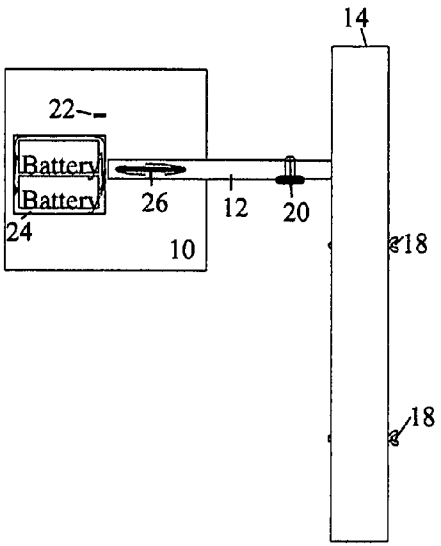
FIG. 3 shows a top view of my invention.

FIGS. 5–6 show cut away views of the top and side of the target source containment base 14. Target sources 16*a*, 16*b*, and 16*c* are held in place by target source connection pins 18*c*, and 18*e*. The target source connection pins 18*c* and 18*e* connect to the target source containment base 14. Target sources 16*b* and 16*c* are connected to the target source connector rod 18*d*, which is connected to the target source adjuster screw 18*a*. The target source adjuster screw 18*a* passes from one side of the target source containment base to the other side 14 and is secured with the target source adjuster wing nut 18*b*. The opening on the target source containment base is 1½" long and ¼" in width for the target source adjuster screw 18*a* which connects to the target source used to show the intermediate target 16*b*. The opening on the target source containment base is 3" long and ¼" in width for the target source adjuster screw 18*a* which connects to the intermediate target source 16*c* used to show the intermediate surface-target. The target sources 16*a*, 16*b*, and 16*c* receive power from the target source wiring 26, which is connected to the batteries located in the base 24 as shown in FIG. 3.

Operation—FIGS. 1 through 6

To operate the Target Identifier Sports Training Aid, the practitioner must first press the target source on and off switch 24 to the "on" position. After the target sources are turned on, the practitioner must set the Target Identifier Sports Training Aid onto the surface of which he or she is standing. Once the practitioner has identified the particular golf cup in which he or she wants the golf ball to enter, the practitioner must adjust the surface-target displayed by the ultimate target source 16*c* and the intermediate target source 16*b* so that the target sources display surface-targets at the proper distances. The surface-target displayed by the ultimate target source 16*c* will be at the same distance as that of the selected golf cup, and the surface-target displayed by the intermediate target source 16*b* will be at a distance arbitrarily chosen by the practitioner.

To adjust the distance for the surface-target displayed by the ultimate target source 16*c*, the target source wing nut 18*b* is loosened and the target source adjuster screw 18*a* is moved forwards or backwards until the surface-target displayed by the target source (ultimate target) 16*c* is at the same distance as the selected golf cup. Once the correct distance is acquired, the target source wing nut 18*b* must be retightened. After achieving the proper distance, proper alignment is achieved by rotating the weighted base 10, until the surface-target displayed by the ultimate target source 16*c* is pointed directly towards the selected golf cup. If the golf ball will not roll in a straight line because of slope of the terrain on which the practitioner is standing, the surface-target displayed by the ultimate target source 16*c* should be pointed towards a selected breaking point. The selected breaking point is chosen by determining how much the ball will turn before it gets to the selected golf cup. For example, if it is determined that the golf ball will turn 3' before it gets to the golf cup, the surface-target displayed by the ultimate target source 16*c* should be pointed towards a point 3' to the side of the golf cup instead of being pointed directly towards the golf cup.

After acquiring proper distance and alignment for the surface-target displayed by the ultimate target source 16*c*, the practitioner should adjust the distance for the surface-target displayed by the intermediate target source 16*b*. There is no right or wrong distance for the surface-target displayed by the intermediate target source 16*b* because the distance varies from one practitioner to another. The practitioner should experiment with various distances and select the one that gives him or her the most consistent achievement of the desired goal. To adjust the surface-target displayed by the intermediate target source 16*b*, the target source wing nut 18*b* is loosened and the target source adjuster screw 18*a* is moved forwards or backwards until the surface-target is displayed at the desired point. Once the intermediate target source 16*b* displays the surface-target upon the desired point, the target source wing nut 18*b* for the intermediate target source 16*b* must be retightened.

After the surface-targets displayed by the ultimate target source 16*c* and the intermediate target source 16*b* have been set, the practitioner must place a golf ball upon the surface-target displayed by the beginning point target source 16*a*. After the golf ball is placed in this position, the practitioner's goal is to strike the golf ball so that it travels over the surface-target displayed by the intermediate target source 16*b*. The practitioner must also strike the golf ball with the necessary force as to cause the ball to end up at the surface-target displayed by the ultimate target source 16*c*. Once the practitioner has finished using the Target Identifier Sports Training Aid, the target source on and off switch 22 should be pressed to the "off" position.

Figure 9:
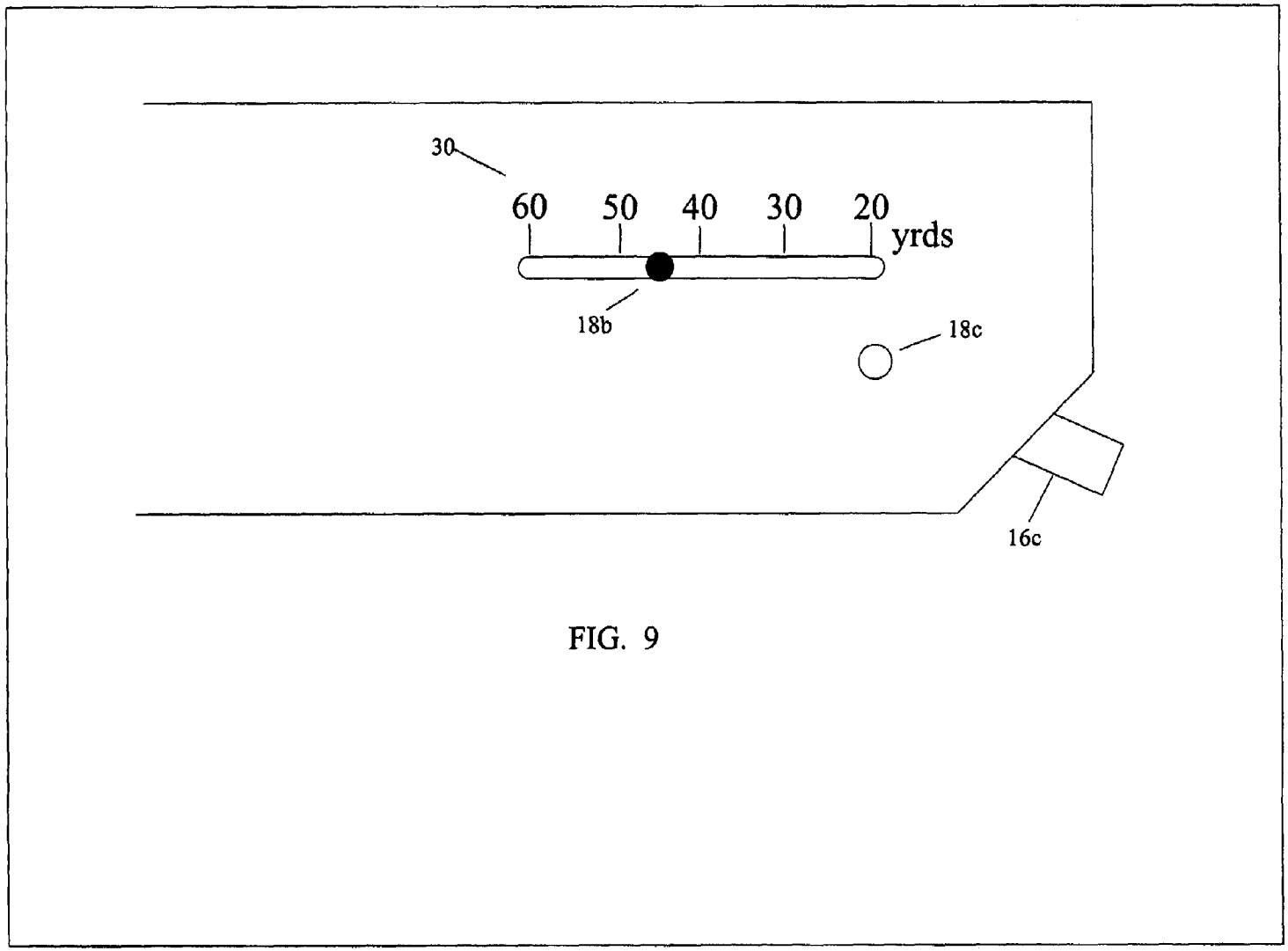
FIG. 9 shows the partial side view of the Target Source Containment Base with an optional Yardage Indicator.

FIG. 9—Additional Embodiments

An Additional Embodiment is shown in FIG. 9. The Target Source Containment Base 14 has been modified to add an additional Target Source (Ultimate Target) Yardage Indicator 30. In this ramification, the practitioner is able to position the surface-target displayed by the ultimate target source 16*c* at a known distance. This allows the practitioner to know exactly how far it is to the surface-target displayed by the ultimate target source 16*c* so that he or she can develop a "feel" for knowing how hard to hit an object to cause the object to travel a certain distance. This ramification is useful in putting, but an additional ramification is that of chipping and pitching in the game of golf.

FIGS. 7–8, and 10–12—Alternative Embodiments

Figure 7:
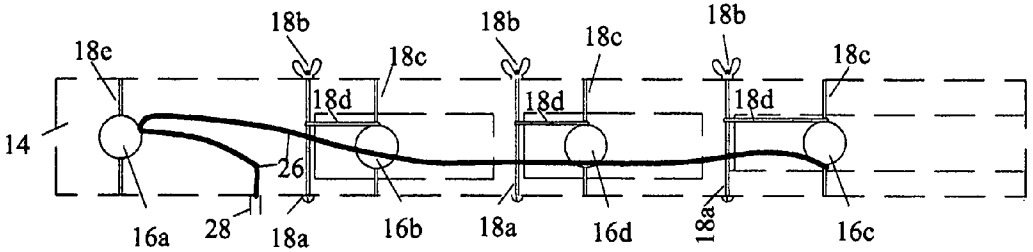
FIG. 7 shows the cut away view of the top of the Target Source Containment Base with an optional Additional Target Source.
Figure 8:
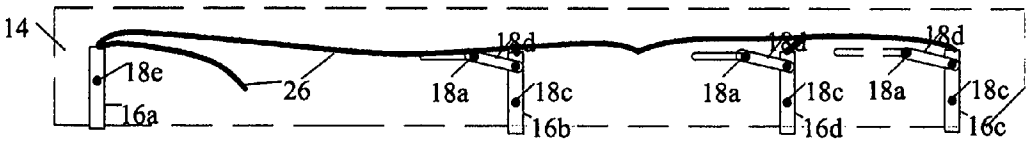
FIG. 8 shows the cut away view of the side of the Target Source Containment Base with an optional Additional target source.

Alternative embodiments are shown in FIGS. 7, 8, and 10–12. In FIGS. 7 and 8, an Additional Intermediate Target Source 16*d* has been added. In this ramification, only one Additional Intermediate Target Source has been added, but with modifications of the Target Source Containment Base 14, more Additional Intermediate Target Sources 16*d* can be added. The Additional Intermediate Target Source 16*d* will function exactly as the Intermediate Target Source 16*b* so as to provide the practitioner with optional targets (goals). This embodiment would be very useful in a sport such as bowling, or any other sports where multiple intermediate surface-targets are useful in causing an object to pass through intermediate surface-targets before entering or crossing the ultimate target.

Figure 10:
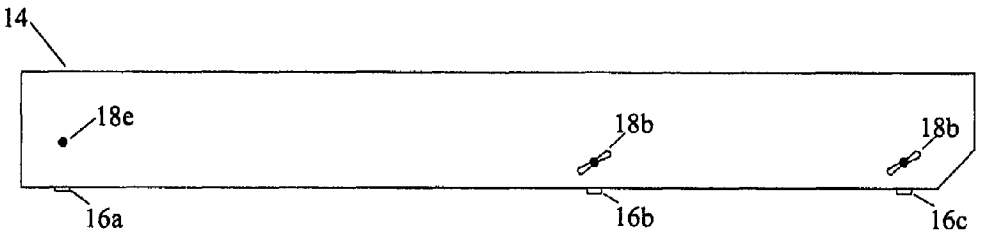
FIG. 10 shows a right side view of an alternate non-cavity Target Source Containment base with Target Sources mounted directly to side of Base.
Figure 11:
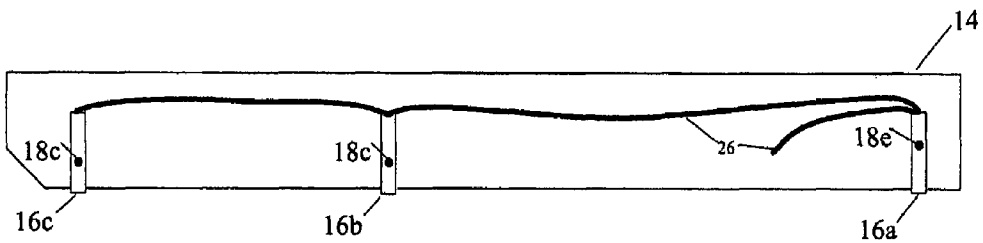
FIG. 11 shows a left side view of an optional non-cavity Target Source Containment Base with Target Sources mounted directly to side of Base.

In FIGS. 10 and 11, the Target Source Containment Base 14 contains no internal cavity. The Target Source Containment Base 14 is designed to allow the Beginning Point Target Source 16*a*, Intermediate Target Source 16*b*, and the Ultimate Target Source 16*c*, to be mounted directly to the side of the Target Source Containment Base 14. The Intermediate Target Source 16*b*, and the Ultimate Target Source 16*c* are adjusted by loosening the Target Source Adjuster Wing Nut 18*b*, manually rotating the Target Sources (16*b* or 16*c*) until the surface-target is displayed at the desired position, and then retightening the Target Source Adjuster Wing Nut 18*b*.

ADVANTAGES

From the description above, a number of advantages of my Target Identifier Sports Training Aid become evident:

(a) The golfer or sports practitioner has a practice aid that provides him or her with a stationary alignment reference surface-target on which he or she can focus throughout the golf swing or stroke. This improves the practitioner's ability to keep his or her body, head, and eyes still throughout the "stroke," and this improves the practitioner's chances of success.

(b) The golfer or sports practitioner has a practice aid that provides him or her with an intermediate surface-target. This target allows the practitioner to focus upon a surface-target (goal) that is close to him or her and because this surface-target (goal) is close, the practitioner will believe that he or she can achieve the goal on a consistent basis.

(c) The golfer or sports practitioner has a practice aid that enables him or her to quickly select a different ultimate target and continue to practice without wasting time reestablishing correct alignment positions from the golf ball (beginning point) to an "intermediate target" and finally to the golf cup (ultimate target).

(d) The golfer or sports practitioner has a practice aid that improves their skills and confidence because it improves his or her frequency of achieving the goal of causing an object to enter into the "ultimate target."

CONCLUSIONS, RAMIFICATIONS, AND SCOPE

Accordingly, the reader will see that the Target Identifier Sports Training Aid can be used by the practitioner to help him or her become a great putter. Furthermore, the Target Identifier Sports Training Aid has the additional advantages in that

- it permits additional intermediate target sources to be added for different sport as to offer the practitioner alternate intermediate surface-targets.
- it can be used as a practice aid for many different sports where it is beneficial to focus upon an "intermediate target," as opposed to focusing upon the "ultimate target."
- it allows the practitioner to know the exact distance to the "ultimate target." This allows the practitioner to know how much force must be exerted to cause an object to reach the "ultimate target."

The Target Identifier Sports Training Aid's preferred construction material is a thin, rigid, and lightweight plastic. Those skilled in the art will recognize that this training aid may be embodied in several alternate forms, which have not been illustrated, without departing from the purpose of this training aid. The illustrated embodiments are therefore to be considered in all respects illustrative and not restrictive. Although the description above contains many specificities, these should not be construed as limiting the scope of the invention but as merely providing illustrations of some of the presently preferred embodiments of this invention. For example, the weighted base 10 shown in FIGS. 1 and 2 could be round, oval, rectangular, triangular, etc. It also could be made out of metal, fiberglass, etc. Thus, the scope of the invention should be determined by the appended claims and their legal equivalents, rather than by the examples given.

I claim:

1. A practice aid that instills, in a sports practitioner, accurate targeting, proper alignment, consistency, and confidence, comprising:

(a) a plurality of targeting sources, wherein said targeting sources are attached to a targeting source containment base, said targeting sources are of a predetermined size sufficient to fit within or upon the containment base, a means of connecting said targeting sources to the containment base so that said targeting sources are adjustable, said targeting sources capable of emitting a visible surface-target upon a surface on which the practitioner stands, wherein said targeting sources receive power from a target source power wire connected to a power source, said targeting sources of comprising a beginning point target source, a intermediate target source, an ultimate target source, said targeting source containment base is of sufficient size as to be portable, said targeting source containment base is constructed of a rigid material, a means of connecting said targeting source containment base to a support shaft, said targeting source containment base having an internal cavity of sufficient size as to contain said targeting sources, a bottom of said targeting source containment base having openings to allow said targeting sources to emit a visible surface-target upon a surface on which the practitioner stands, said targeting source containment base having an ultimate target yardage indicator, wherein said ultimate target yardage indicator is affixed upon the side of said targeting source containment base, said ultimate target yardage indicator is visible above a recess where said ultimate target source is connected to said targeting source containment base, said ultimate target yardage indicator is comprised of a series of numbers with equal increments, (b) a support shaft constructed of a rigid material, wherein said support shaft is of sufficient length to allow a surface-target to be displayed upon the surface on which the practitioner stands without said targeting source containment base interfering with the practitioner, a means of connecting said support shaft to said target source containment base, a means of adjusting the angle between said support shaft and said target source containment said target source power wire, (c) a base constructed of a rigid material, said base of sufficient weight as to prevent toppling of said target sources, said target source containment base, and said support shaft, said base is of sufficient size as to accommodate said power source, said base having a cavity to house said power source and said target source power wire, said base having a target source on and off switch where said target source on and off switch utilizes a means to allow or disallow power from said power source to said target sources.

* * * * *